US005193993A

United States Patent [19]

Dietiker

[11] Patent Number: 5,193,993

[45] Date of Patent: Mar. 16, 1993

[54] SAFE GAS VALVE

[75] Inventor: Paul Dietiker, Redondo Beach, Calif.

[73] Assignee: Honeywell Inc., Minneapolis, Minn.

[21] Appl. No.: 831,785

[22] Filed: Feb. 5, 1992

[51] Int. Cl.[5] ..... F23Q 9/12

[52] U.S. Cl. ..... 431/51; 137/66; 251/68; 431/57; 431/84

[58] Field of Search ..... 431/51, 84, 57, 52, 431/60, 72, 83; 137/66; 251/89, 68, 67, 66, 100

[56] References Cited

U.S. PATENT DOCUMENTS 2,258,811 10/1941 Ray ..... 251/68 X
2,363,073 11/1944 Mantz ..... 137/66
3,021,857 2/1962 Davidson .
3,045,690 7/1962 Nickells ..... 137/66
3,354,490 11/1967 Dietiker et al. .
3,602,239 8/1971 Battersby ..... 251/96 X
3,763,875 10/1973 Möbus et al. ..... 137/66
3,973,576 8/1976 Dietiker et al. .
3,999,932 12/1976 Matthews .
4,442,853 4/1984 Gort ..... 137/66
4,543,974 10/1985 Dietiker et al. .
4,549,571 10/1985 Kelly .
4,729,396 3/1988 Kelly et al. ..... 137/66

*Primary Examiner*—Stephen M. Hepperle
*Attorney, Agent, or Firm*—Charles L. Rubow

[57] ABSTRACT

A gas valve having a main valve closure member whose position is controlled both by a pivoting lever arrangement and a thermostatically controlled solenoid. The closure member is biased toward the lever by a spring between the closure member and the lever, and the lever is biased to position the closure member against a stationary valve seat. The lever is pivotable against its bias by a mechanical latch arrangement which forms part of a manual control, whereby when the lever is pivoted against its bias, the thermostatically controlled solenoid is permitted to engage the closure member, and, in the absence of demand from the thermostat, to move the closure member toward the valve seat against the bias of the spring between the closure member and lever.

12 Claims, 2 Drawing Sheets

SAFE GAS VALVE

BACKGROUND OF THE INVENTION

The invention broadly relates to control valves, and is specifically directed to a gas valve for gas fueled appliances which valve permits operation only when a pilot burner in the appliance is in operation.

U.S. Pat. No. 3,973,576, which issued on Apr. 10, 1976, and is commonly known with this patent application, discloses a gas valve opened by a mechanism that is actuated only if a pilot flame is established. Such a "supersafe" function is a requirement in many European countries. This requirement is satisfied by the gas valve of U.S. Pat. No. 3,973,576.

Current U.S. regulations, however, require that such valve include dual, independently operable safety mechanisms to ensure that the valve is automatically closed in the event a problem is encountered with the gas appliance, thus cutting off the supply of gas to the appliance. In addition, current U.S. regulations require that, after a gas valve is operated to light the pilot flame on the appliance, a manual movement other than simple release of a control knob must be performed in order to initiate supplying of gas to the main burner.

The present invention is a modification of the valve of U.S. Pat. No. 3,973,576 which brings it into compliance with current U.S. regulations, while maintaining compliance with European "supersafe" requirements.

SUMMARY OF THE INVENTION

The gas valve of the present invention includes a condition controlled actuator, such as a solenoid operated by a remote thermostat or other controller, which interacts with a "supersafe" mechanism in such a way that either the actuator or the mechanism is operable to close the valve. The "supersafe" mechanism may include a valve closure member carried by a lever that is normally spring biased to urge the closure member into a closure position with the main valve seat. A latch mechanism carried by a manually operated control knob and shaft is capable of latchably engaging the spring biased lever during normal operation and after a pilot flame has been established. If the pilot flame is extinguished, the latching mechanism is tripped by an independently operating power unit capable of remotely sensing the presence of a pilot burner flame, and the lever thereafter moves the closure member to close the main valve.

In the preferred embodiment, the solenoid includes a plunger disposed in a collinear relationship with the valve stem of the valve closure member. The solenoid plunger is normally urged by a biasing spring into an extended position in which it linearly engages the valve closure member and closes the main valve regardless of the position of the lever in the "supersafe" mechanism. In the presence of a demand signal supplied to the solenoid, the solenoid plunger is retracted, permitting the valve to open. Thus, as long as a pilot flame is established, the solenoid opens and closes the main valve as a function of demand. However, in the event the pilot flame is extinguished, the spring biased lever of the "supersafe" mechanism is tripped to close the main valve, regardless of the demand or operating mode of the solenoid.

DESCRIPTION OF THE PREFERRED EMBODIMENT

Figure 1:
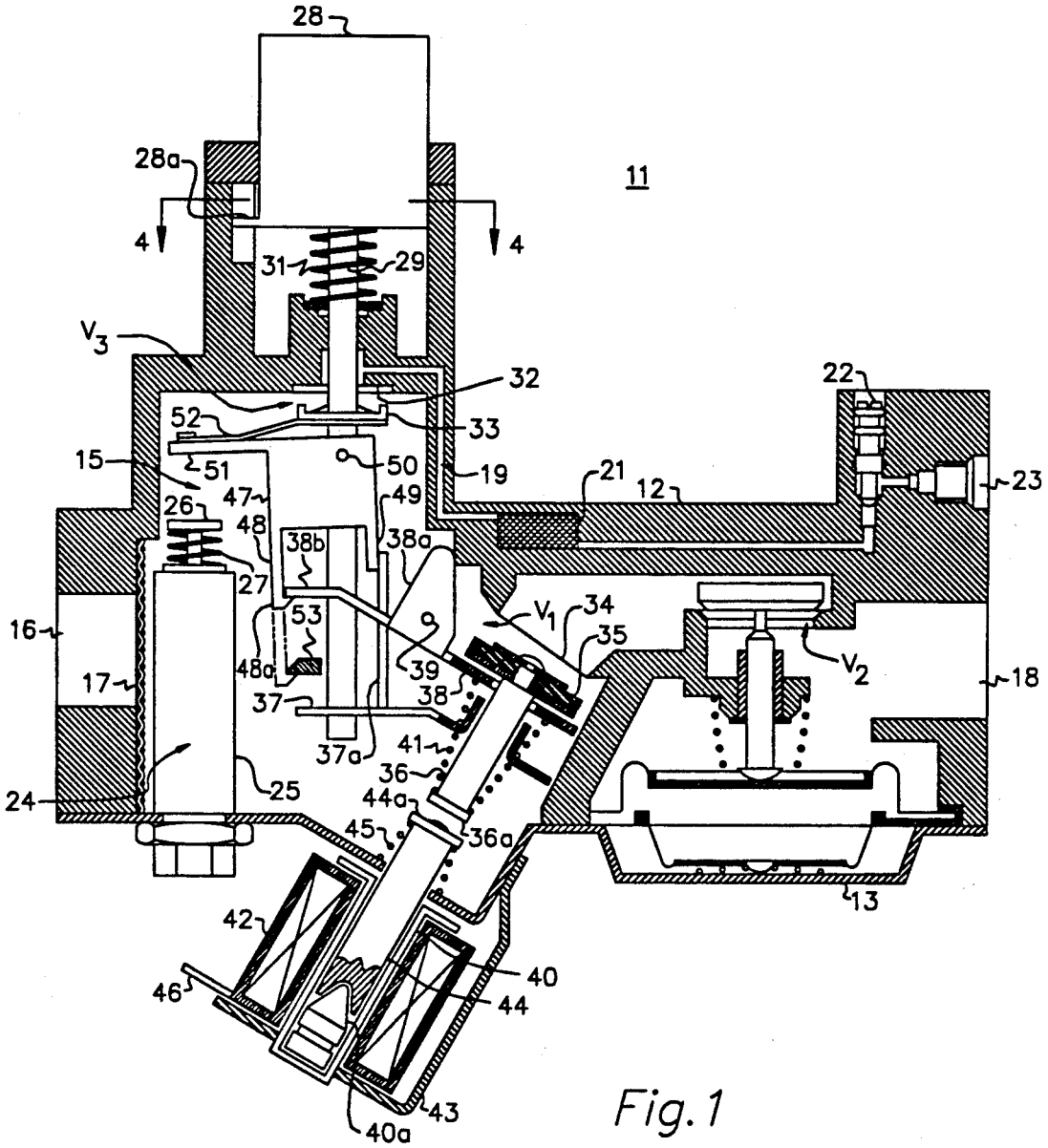
FIG. 1 is a sectional view of a gas valve embodying the applicant's invention, with portions thereof represented schematically, and with the gas valve in a first state of operation.

With initial reference to FIG. 1, a gas valve embodying the invention is generally identified by reference numeral 11. Valve 11 includes a housing 12 which may be cast or molded from a suitable material. Housing 12 has an open bottom closed by a bottom wall member 13. Housing 12 and bottom wall member 13 together define chamber 15 adapted for connection to a source of natural or l.p. gas. In operation, gas flows to chamber 15 through an inlet 16 and a screen 17, and from chamber 15 through an outlet 18 adapted for connection to a gas fueled appliance. Between inlet 16 and outlet 18, a pair of valve members $V_1$ and $V_2$ are arranged in series. Both of valve members $V_1$ and $V_2$ must be open for gas to be delivered through outlet 18 to the appliance, and closure of either valve member interrupts the flow of gas to the appliance.

A valve member $V_3$, which will be discussed in detail hereinafter, serves as a pilot valve which controls gas flow from inlet 16 to a pilot passage 19. A filter 21 is disposed in pilot passage 19, as is an adjustable orifice valve 22 which limits the flow of pilot gas through a pilot outlet 23 to a pilot burner in the appliance.

A power unit 24 is mounted in housing 12. Power unit 24 includes a solenoid 25 having a solenoid plunger 26 normally biased to an extended position by a spring 27. Plunger 26 is shown in its extended position in FIGS. 2 and 3.

Solenoid 25 is actuated by a remote thermocouple (not shown) disposed adjacent the pilot burner of the appliance. In the presence of a pilot flame, solenoid 25 is energized, retracting the plunger 26 against the bias of spring 27 to the position shown in FIG. 1.

With continued reference to FIG. 1, a manual control knob 28 projects externally of the housing 12 and is carried on a vertical shaft 29 which is mounted for both rotation and axial movement in housing 12. Knob 28 includes a laterally projecting guide member **28*a*, the purpose of which is discussed in further detail hereinafter. Knob 28 and shaft 29 are urged upwardly by a coil spring 31, although knob 28 is shown in a depressed position in FIG. 1. Shaft 29 and the plunger 26 of solenoid 25** are disposed in a parallel but offset relationship.

An annular valve seat 32 defined by housing 12 encircles shaft 29. A valve closure member 33 is mounted on shaft 29, and is adapted to achieve a sealing relationship with seat 32. Seat 32 and closure member 33 together comprise pilot valve $V_3$, which is shown in its open position in FIG. 1 with knob 28 depressed. Conversely, valve $V_3$ is shown in its closed position in FIG. 2, with shaft 29 and knob 28 in their uppermost or extended positions.

Valve $V_1$ includes an annular valve seat 34 defined within housing 12 and a valve closure member 35 mounted at the upper end of an angularly disposed valve stem 36. Valve stem 36 slides axially through a circular opening or sleeve in a stationary bracket 37 in housing 12 within chamber 15.

Valve stem 36 also moves axially through a circular aperture formed in one end of a lever 38. Lever 38 includes at least one mounting arm 38*a* by which it is pivotally mounted to housing 12 through a pivot pin 39. Lever 38 is normally biased in a counterclockwise direction as viewed in FIG. 1 by a spring (not shown).

The lower end of stem 36 is formed with a collar or retainer 36*a*, and a conical spring 41 is disposed in compression between the underside of lever 38 and retainer 36*a*. As constructed, spring 41 normally urges valve closure member 35 into contact with the upper side of lever 38. With lever 38 in the position shown in FIG. 1, valve closure member 35 is urged away from valve seat 34 so that valve $V_1$, which is a main safety valve, is in an open position.

An electromagnetic actuator or solenoid 42 is carried by an external bracket 43 attached to bottom wall member 13. Actuator 42 includes a plunger 44 which is disposed in co-linear relationship with valve stem 36. Plunger 44 projects into the housing chamber 15 through an opening in bottom wall member 13. Plunger 44 includes a retainer 44*a* at its upper end, and a conical spring 45 is disposed in compression between bottom wall member 13 and retainer 44*a*. Within actuator 42, the inner end of plunger 44 is formed with a conical depression sized and positioned to mate with a pointed resilient block 40*a* disposed in the base of a tubular guide 40 to absorb noise when actuator 42 is energized and plunger 44 is retracted into the position shown in FIG. 1.

Actuator 42 includes a pair of terminals 46 (only one of which is shown in FIG. 1) adapted for connection to a remote thermostat or other controller. The presence of an "on" signal at terminals 46 energizes actuator 42, retracting plunger 44 against the bias of spring 45 and out of engagement with valve stem 36. An "off" signal at terminal 46 de-energizes actuator 42, allowing spring 45 to extend plunger 44 into engagement with valve stem 36, thus closing valve $V_1$. It is this "on/off" control signal that causes the gas appliance to be supplied with gas on demand when lever 38 is actuated to the position shown in FIG. 1.

Valve $V_2$ is a conventional pressure operated valve which can be controlled from a pressure regulator and an electrically controlled pilot valve of the type shown in U.S. Pat. No. 3,354,901, which issued on Nov. 28, 1967.

Figure 2:
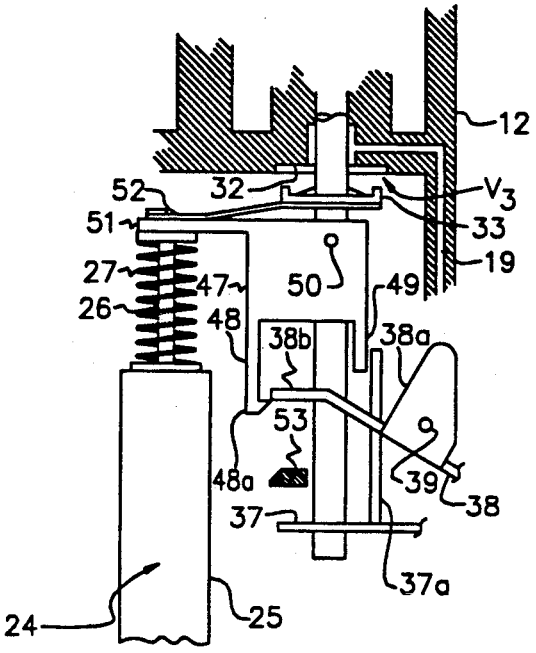
FIG. 2 is a fragmentary sectional view of the gas valve of FIG. 1 in a second state of operation.
Figure 3:
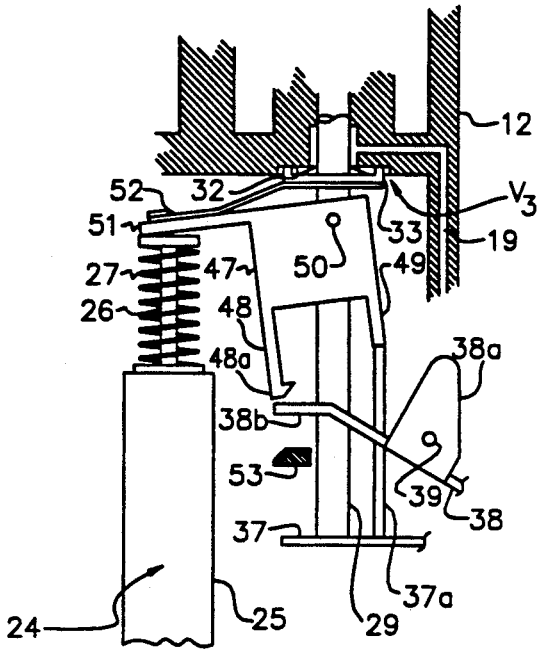
FIG. 3 is a fragmentary sectional view of the gas valve of FIG. 1 in a third state of operation.

With reference to FIGS. 1-3, a tilting latch member 47 is pivotally mounted to shaft 29 by a pivot pin 50. This arrangement is structurally and functionally similar to the tilting latch member disclosed in previously identified U.S. Pat. No. 3,973,576. Latch member 47 includes downwardly extending latch legs 48, 49 which perform functions as described in further detail hereinafter.

Latch member 47 has a laterally extending tail portion 51 which is engageable by the upper end of plunger 26 of power unit 24 when knob 28 and shaft 29 are rotated to a predetermined position as discussed below. A leaf spring 52 acts between valve closure member 33 and the upper side of tail portion 51 to bias latch member 47 in a counterclockwise direction about pin 50 as viewed in FIGS. 1-3. Plunger 26 is extendable to engage tail portion 51 to move latch member 47 in a clockwise direction to its upright or non-latching position against the bias of spring 52 (see FIG. 2). Latch member 47 may also be moved into engagement with retracted plunger 26 as shaft 29 is moved downwardly, which also causes latch member 47 to be rotated to a non-latching position.

Lever 38 has an end 38*b* which is disposed to be latchably engaged by a latching foot 48*a* of latch leg 48 in one of the operational states of valve 11, as described below. A fixed latch member 53, mounted in a stationary position within housing chamber 15 by means not shown, is disposed below lever end 38*b* in a position to be engaged by and to retain latching foot 48*a* when knob 28 is depressed, as represented by the phantom outline in FIG. 1.

As shown in FIG. 1, bracket 37 includes a vertically extending leg 37*a* which is engaged by latch leg 49 when latch member 47 is tilted in a counterclockwise direction. This engagement may be against the side of leg 37*a*, or against the upper end of member 37*a* as shown in FIG. 3, depending on the operational state of the valve.

Figure 4:
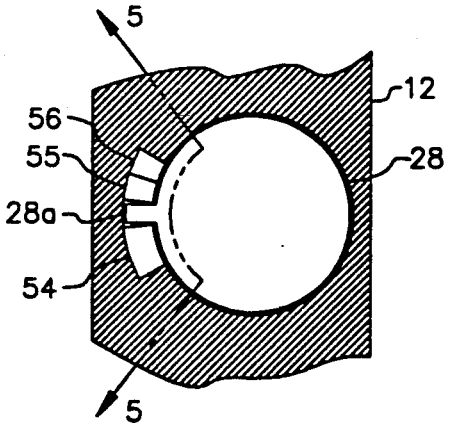
FIG. 4 is a fragmentary sectional view taken along line 4—4 in FIG. 1.
Figure 5:
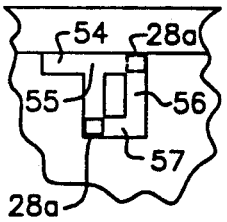
FIG. 5 is a sectional view taken along line 5—5 in FIG. 4.

With reference to FIGS. 4 and 5, knob 28 may be rotated between "off", "pilot" and "on" positions, as permitted by guide member 28*a* of the knob of the knob and its interrelationship with three vertically oriented but laterally spaced guide channels 54-56. Channel 54 corresponds to the "off" position, channel 55 corresponds to the "pilot" position, and channel 56 corresponds to the "on" position.

As shown in FIG. 5, channels 54-56 are in open communication at their top ends, permitting guide member 28*a* to be freely rotated from one to another. Channel 54 is shallow, and prevents knob 28 from being depressed to open pilot valve $V_3$. Channels 55 and 56 are of equivalent depth, and are interconnected at their lowest point by a short lateral channel 57. Guide member 28*a* of knob 28 is represented by solid lines in the "pilot" position, and by phantom lines in the "on" position.

In operation, it will be initially assumed that knob 28 is in the "off" position, the gas appliance to which valve 11 is connected has been inoperative for a period of time, and there is no demand by the thermostat or other controller connected to actuator 42. Thus, the pilot flame of the appliance has been extinguished and the burner of the appliance is cool.

In this operational state, the remote thermocouple connected to power unit 24 is in a cool state and solenoid 25 is de-energized. Shaft 29 and knob 28 are urged upwardly to the position shown in FIG. 3 by spring 31, closing pilot valve $V_3$. With guide member 28*a* located in shallow channel 54, corresponding to the "off" position of knob 28, the knob cannot be depressed to the point of opening pilot valve $V_3$.

Although in the assumed operational state of valve 11, knob 28 can be rotated to its "on" position, gas valve 11 will not provide for flow of gas unless a pilot flame is established. Specifically, with knob 28 rotated to the "on" position, the end of latch leg 49 is positioned immediately above bracket leg 37*a*, and depression of knob 28 in this rotational position is prevented by the engagement of the ends of these members. This functionally prevents valve $V_1$ from being opened.

Also, with knob 28 rotated to either the "off" or "on" position without a pilot flame, the end 38*b* or lever 38 is not engaged by latching foot 48*a* (see FIG. 3), and lever 38 is therefore urged in the counterclockwise direction, thus closing valve $V_1$. Because of this overriding feature, valve $V_1$ remains closed whether or not there is a demand signal from the remote thermostat on terminals 46. Valve $V_2$ will also be closed under these conditions.

To enable operation of the gas appliance, the appliance pilot flame must first be lit. This is accomplished by rotating knob 28 to the "pilot" position shown in FIGS. 4 and 5, in which guide member 28*a* is disposed in guide channel 55. At the same time, latch leg 49 is also rotated out of abutment with bracket leg 37*a*, thus permitting knob 28 to be depressed. As this downward movement of latch member 47 continues, tail portion 51 engages extended plunger 26, which initially causes latch member 47 to be rotated to its clockwise position shown in FIG. 2. Further downward movement causes tail portion 51 to depress plunger 26, and latching foot 48*a* to be positioned adjacent to, but not engaged by fixed latch member 53.

In this position of shaft 29 and valve closure member 33, pilot valve $V_3$ is open and gas flows through pilot passage 19 to the appliance pilot burner, which can then be lit manually or automatically. Once the pilot flame is established, the flame sensing thermocouple supplies a signal to solenoid 25 which causes it to retract plunger 26 to the position shown in FIG. 1. This permits latch member 47 to rotate counterclockwise to its latching position, and to be retained by fixed latch member 53, as illustrated by the phantom line representation of latching font 48*a* in FIG. 1.

Valve $V_1$ remains closed regardless of the demand of the remote thermostat because lever end 38*b* is not engaged and the lever continues to be urged in a counterclockwise direction, thus holding valve closure member 35 against seat 34. The purpose of fixed latch member 53 is to require a separate manual of movement of the knob 28 after it has been depressed in the "pilot" position, thus preventing premature ignition of the main burner of the appliance.

After the appliance pilot flame is established, valve 11 may be turned to its "on" position by rotating knob 28 until guide member 28*a* is aligned with channel 56. As rotation takes place, latching foot 48*a* becomes disengaged from fixed latch member 53, and spring 31 urge knob 28 and shaft 29 vertically upward. Latching foot 48*a* is then in vertical alignment with lever end 38*b*, and with plunger 26 remaining in its retracted position, leaf spring 52 causes tilt latch member 47 to remain in its counterclockwise position shown in FIG. 1. Release of knob 28 results in vertical engagement of lever end 38*b* by latching foot 48*a* which lifts the lever end and pivots lever 38 in the clockwise direction as viewed in FIG. 1. This movement enables actuator 42 to control valve $V_1$ as a function of the demand from the remote thermostat or other controller.

Stated otherwise, in the presence of a demand signal at terminals 46, actuator 42 is energized and retracts plunger 44 to the position shown in FIG. 1, which causes valve $V_1$ to open under the influence of spring 41. If the remote thermostat does not generate a signal, actuator 42 remains de-energized, and plunger 44 is extended by spring 45 to engage and move plunger 36 against the bias of spring 41, thus closing valve $V_1$.

In the event the appliance pilot flame is extinguished for any reason, the remote thermocouple connected to power unit 24 cools and solenoid 25 is deenergized. As a result, spring 27 causes plunger 26 to extend and engage tail portion 51, causing tilt latch member 47 to pivot in the clockwise direction and release the latching engagement between latching foot 48*a* and lever end 38*b*. The position of tilt latch member 47 at this point is shown in FIG. 2. Spring 31 then urges knob 28 and shaft 29 upwardly to the position shown in FIG. 3, which closes pilot valve $V_3$. Simultaneously, lever 38 rotates in a counterclockwise direction to close valve $V_1$.

It may be observed by comparing FIGS. 2 and 3 that the extension of plunger 26 is limited, and as shaft 29 and knob 28 move upwardly to close valve $V_3$, tilt latch 47, under the influence of leaf spring 52, pivots slightly in counterclockwise direction as shown in FIG. 3. In this position that latch leg 49 overlies the end of bracket leg 37*a*, preventing knob 28 from being depressed. Safety valve $V_1$ can only be opened by returning knob 28 to the "pilot" position and following a pilot lighting procedure.

It will be appreciated that the collinear arrangement of plunger 44 and valve stem 36, together with their associated mechanisms, enables the remote thermostat to control the opening and closing of valve $V_1$ as a function of demand, so long as a pilot flame exists and lever 38 is in the position shown in FIG. 1. In the event the pilot flame is extinguished for any reason, it is essential that the flow of gas to both the pilot and main burners be immediately shut off. This is achieved by the extension of plunger 26 and the corresponding release of lever 38 from latch member 47, causing counterclockwise rotation of the lever to close valve $V_1$.

Although a particular embodiment of the invention has been shown and described for illustrative purposes, a variety of modifications and other embodiments within the applicant's teaching will be apparent to those skilled in the relevant arts. It is intended that legal coverage not be limited to the disclosed embodiment, but only by the terms of the following claims.

I claim:

1. A gas valve for a gas burning appliance, comprising:

housing means defining an inlet adapted for connection to a source of gas, a main outlet adapted for connection to a gas burning appliance and a pilot outlet adapted for connection to a pilot burner in the appliance;

pilot valve means disposed between the inlet and pilot outlet for controlling the flow of gas therebetween;

manually operated control means operatively connected to the pilot valve means and movable between a first position in which the pilot valve means is closed and a second position in which the pilot valve means is open, said manually operated control means being normally biased to the first position;

main valve means disposed between the inlet and main outlet for controlling the flow of gas therebetween, said main valve means including a valve seat defined by said housing means, valve closure means mounted in said housing means and adapted for movement between a first position in which said main valve means is closed and a second position in which said main valve means is open, and a first spring biasing the valve closure means toward its first position;

lever means movably mounted in said housing and having an end biased to a first position toward the valve seat, said lever means being adapted to cooperate with the valve closure means such that the valve closure means is held in its second position when said end of said lever means is in its first position, the first biasing force at said end of said lever means being sufficient to overcome the force applied to the valve closure means by the first spring;

latch means mounted on said manually operated control means and alterably engageable with said lever means to move said end thereof away from the valve seat when said manually operated control means is in its second position;

pilot valve control means engageable with said latch means in the absence of a pilot flame at the pilot burner in the appliance, said pilot valve control means being adapted, when engaging said latch means, to cause said latch means to disengage from said lever means to close said main valve means; and actuator means adapted to cooperate with the valve closure means, said actuator means being operable between demand and no demand states as a function of a controlled condition, said actuator means in its no demand state being effective to move the valve closure means to its second position against the bias of the first spring to close the main valve means.

2. The gas valve defined by claim 1 wherein:

the valve closure means comprises a valve closure member mounted on a linearly movable valve stem; and said actuator means comprises a solenoid having a plunger linearly movable between extended and retracted positions, said valve stem and plunger being disposed in collinear relationship.

3. The gas valve defined by claim 2 wherein the solenoid plunger is retracted in its demand state and extended in its no demand state to engage and linearly move the valve stem to close the main valve means.

4. The gas valve defined by claim 3 wherein the first spring is disposed between said end of said lever means and the valve stem to urge the valve closure member toward said lever means.

5. The gas valve defined by claim 3 wherein the solenoid plunger is normally urged by a second spring into its extended position, the plunger being retracted in response to a demand signal.

6. The gas valve defined by claim 1 wherein the lever means is pivotally mounted to the housing means.

7. The gas valve defined by claim 1, wherein said manually operated control means is movable to a third position in which said pilot valve means is open and said latch means does not engage the lever means, whereby said main valve means is maintained in a closed condition.

8. The gas valve defined by claim 7 including first retention means mounted in a fixed position within said housing for retaining the manually operated control means in its third position.

9. The gas valve defined by claim 8 which further comprises second retention means adapted to permit release of the manually operated control means from the retention means when a pilot flame is established, and for effecting movement of the manually operated control means to its second position.

10. The gas valve defined by claim 9 wherein:

said latch means is mounted on said manually operated control means for pivotal movement between a first position in which said latch means is engageable with said lever means and a second position in which said latch means is not engageable with said lever means;

biasing means is provided for biasing said latch means toward its first position; and said pilot valve control means, in the absence of a pilot flame, is operable to pivot said latch means to its second position.

11. The gas valve defined by claim 9 wherein:

said manually operated control means is linearly and rotatably mounted in said housing; and said manually operated control means and said housing are configured to form an arrangement of guide channels and a follower member movable in the guide channels, the guide channels being arranged such that in a first rotary position of said manually operated control means, said manually operated control means is precluded from axial movement to a position in which said pilot valve means is open, and in a second rotary position of said manually operated control means, said manually operated control means is permitted to move axially to a position in which it can be rotated to a third rotary position in which said latch means may engage said lever means.

12. The gas valve defined by claim 11 wherein said latch means and said housing are configured such that when said latch means is pivoted to its first position and said manually operated control means is in its axial position in which said pilot valve means is closed, axial movement of said manually operated control means is prevented.

* * * * *